United States Patent [19]

Lueth

[11] Patent Number: 4,579,713

[45] Date of Patent: Apr. 1, 1986

[54] METHOD FOR CARBON CONTROL OF CARBIDE PREFORMS

[75] Inventor: Roy C. Lueth, St. Clair, Mich.

[73] Assignee: Ultra-Temp Corporation, Mt. Clemens, Mich.

[21] Appl. No.: 727,408

[22] Filed: Apr. 25, 1985

[51] Int. Cl.[4] ..... B22F 9/00

[52] U.S. Cl. ..... 419/58; 419/59; 419/60; 75/239; 75/240; 423/439; 423/440; 501/87; 501/94

[58] Field of Search ..... 501/87, 94; 148/133; 423/439, 440; 419/58, 59, 60; 75/239, 240

[56] References Cited

U.S. PATENT DOCUMENTS

| | | | |
|---|---|---|---|
| 3,525,610 | 8/1970 | Meadows | 419/59 |
| 3,891,473 | 6/1975 | Latva | 419/59 |
| 4,028,100 | 6/1977 | Latva | 419/59 |
| 4,153,485 | 5/1979 | Ogata et al. | 419/59 |
| 4,190,439 | 2/1980 | Gortsema | 419/30 |
| 4,225,344 | 9/1980 | Fujimori et al. | 419/59 |
| 4,436,696 | 3/1984 | Buck et al. | 419/59 |

*Primary Examiner*—Stephen J. Lechert, Jr.
*Attorney, Agent, or Firm*—Gifford, Groh, VanOphem, Sheridan, Sprinkle & Dolgorukov

[57] ABSTRACT

The present invention provides a method for controlling the carbon content of dewaxed carbide preforms in a carbon containing furnace. The method includes the steps of placing the preforms in a carbon containing furnace and then heating the furnace to a predetermined temperature range between 800 and 1100 degrees Centigrade. At that temperature, a mixture of methane and hydrogen is introduced into the furnace chamber such that the amount of methane is between 10 and 90 percent of the amount of methane present at equilibrium for the reaction $C_{solid}+2H_2 \rightleftarrows CH_4$. The furnace chamber is maintained at its temperature for a first time period sufficient for the chemical reaction $XC+2H2 \rightleftarrows X+CH_4$ (where X is selected from the group of W, Ti, Ta, Hf and No) substantially reaches equilibrium but shorter than the a second time period in which the reaction $C_{solid}+2H2 \rightleftarrows CH_4$ reaches equilibrium or the resident time of the gaseous mixture is less than the second time period.

14 Claims, 2 Drawing Figures

METHOD FOR CARBON CONTROL OF CARBIDE PREFORMS

BACKGROUND OF THE INVENTION

I. Field of the Invention

Method of correcting and maintaining proper carbon balance in hard metals consisting of various carbides such as WC, TiC, TaC, HfC, MoC or mixtures thereof and various metal binders such as Co, Fe, Ni or mixtures thereof in a carbon containing furnace.

II. Description of the Prior Art

The carbon content of hard metals such as WC—Co alloys must be controlled within very narrow limits in order to optimize the performance of these materials. Much work has been done which shows the detrimental effect on performance of WC—CO alloys which are deficient in carbon or contain an excess of carbon. FIG. 1 shows an isothermal section of the ternary W—C—Co phase diagram at 1400 degrees Centigrade. The region reflecting a proper carbon balance for the desired two phase structure (WC—Co) is that bounded by the phase lines on either side of the dotted line connecting the compound WC and the cobalt corner of the diagrams. If the carbon content deviates over the WC—Co phase line toward the carbon side of the diagram, free carbon will form in the microstructure. If the carbon content deviates below the WC—Co phase line toward the tungsten side of the diagram, eta phase will form in the microstructure. Formation of either of these phases has been shown to be extremely detrimental to the performance of carbide alloys.

The boundaries of these phase lines have been calculated by Suziki (1) to be approximately given by the following formula:

Upper carbon rich boundary $6.13-0.058\times$wt % Co

Lower carbon deficient boundary $6.13-0.079\times$wt % Co

It it also known that even within the two phase field (WC—Co), the properties of the material can vary a great deal with carbon content. In order to optimize properties it is generally accepted that carbon should be held to within + or −0.03% carbon of mid-range for a given alloy.

A great deal of work has been previously done to develop processes and techniques at all production stages of WC—Co alloys such that in the final sintered product, the carbon content will end up in the proper range for a given alloy, i.e. neither carbon deficient (eta phase) nor excessive carbon. Many of these previously known processes are conducted under cover gasses or liquids to prevent powder oxidation which is both difficult and time consuming. Other techniques include extensive carbon analysis of the powder and the addition of carbon or tungsten as required to obtain the desired percentage of carbon content. Even with all of the above precautions and many more, materials out of carbon balance are still produced and routine control to obtain the desired carbon content, ±0.03%, cannot be accomplished.

There have been a number of previously known methods to increase the carbon content in carbon deficient parts and vice versa. For example, G. E. Spriggs: Powder Metall., 1960, 7, 296, has shown that during presintering in hydrogen, complete protection from decarburization by the reaction $WC+WH_2 \rightleftharpoons W+CH_4$ at 800° Centigrade may be accomplished by the addition of 2% by volume of $CH_4$ to the hydrogen. This has been confirmed by S. Takatsu: Powder Metall., Int., 1978, 10, 1, 13, and others.

Gortsema and Kotval: Planseebar, Pulvermetall., 1976, 24,254, and S. Takatsu found that when attempting to carburize WC—Co powders at 750 to 925 degrees Centigrade with various methane additions at 1% to 5% volume, it was difficult to maintain close control of the carbon under atmospheric conditions.

Nissenhalts and Barts, Z. Nissenhalts and J. Barts: Planseeber, Pulvermetall., 1974, 22, 81, previously ran experiments in a carbon free furnace to obtain a thermodynamic equilibrium of the carbon content of WC—Co alloys and a hydrocarbon—H2 gas mixture, namely with a methane, cooking gas or toluene mixture. The materials were exposed to these gaseous mixtures at sintering temperature (1400 degrees C.) and it was found that exact carbon control was difficult to achieve.

Other prior art publications include L. Suzuki and H. Kubota: Planseeber, Pulvermetall., 1966, 14, 96, W. J. Moore: Physical Chemistry., 1962, E. Horvath, Bundesrepublik Deutschland Pat. No. 22 33 852, P. Rautala, J. Norton, Trans. AIME 194, 1045 91952.

None of these previously known methods for correcting the carbon content of carbide preforms, however, have been capable of consistently holding carbon content to ±0.032% or simultaneously correcting carbon deficient and carbon excessive parts.

SUMMARY OF THE PRESENT INVENTION

The present invention provides a method for correcting the carbon content of dewaxed carbide preforms which overcomes all of the above mentioned disadvantages of the previously known methods.

In brief, the method according to the present invention comprises placing the dewaxed preforms in a carbon containing furnace of the type commercially available. The furnace is then heated to a predetermined temperature range, preferably between 800 and 1100 degrees Centigrade, while maintaining the furnace at a vacuum.

A mixture of hydrogen and methane is then introduced into the furnace chamber in which the percentage of methane is between 10 and 90 percent of the quantity of methane necessary to obtain equilibrium of the following equation at the selected temperature and pressure:

$$C_{solid}+2H_2 \rightleftharpoons 2CH_4$$

Following the introduction of the hydrogen and methane mixture into the furnace chamber, the furnace chamber is maintained at the selected temperature and pressure range for a time period sufficient for the following reaction:

$$XC+2H_2 \rightleftharpoons X+CH_4$$

where X is selected from a group of W, Ti, Ta, Hf and Mo to substantially reach equilibrium but in which the reaction:

$$C_{solid}+2H_2 \rightleftharpoons CH_4$$

does not reach equilibrium either due to the total hold time or due to gas resident time but, rather, the methane remains within 10-90 percent of the amount necessary to obtain equilibrium. This time period is between 15 minutes and 5 hours, depending upon the selected temperature, and at 1000 degrees is approximately 90 minutes at one atmosphere pressure.

In tests, it has been found that both carbon deficient dewaxed carbide preforms as well as carbon excessive dewaxed carbide preforms can be simultaeously treated and both the carbon excessive and carbon deficient preforms obtain the desired carbon content following the treatment of the present invention. Furthermore, preforms at the desired carbon content are substantially unaffected following processing according to the method of the present invention. For these reasons, the method of the present invention may reduce or even eliminate the previously known necessity of extensive analysis of the powder carbon content.

BRIEF DESCRIPTION OF THE DRAWING

The present invention will be better understood by reference to the following detailed description, when read in conjunction with the accompanying drawing, wherein like reference characters refer to like parts throughout the several views, and in which.

DETAILED DESCRIPTION OF THE PRESENT INVENTION

Figure 1:
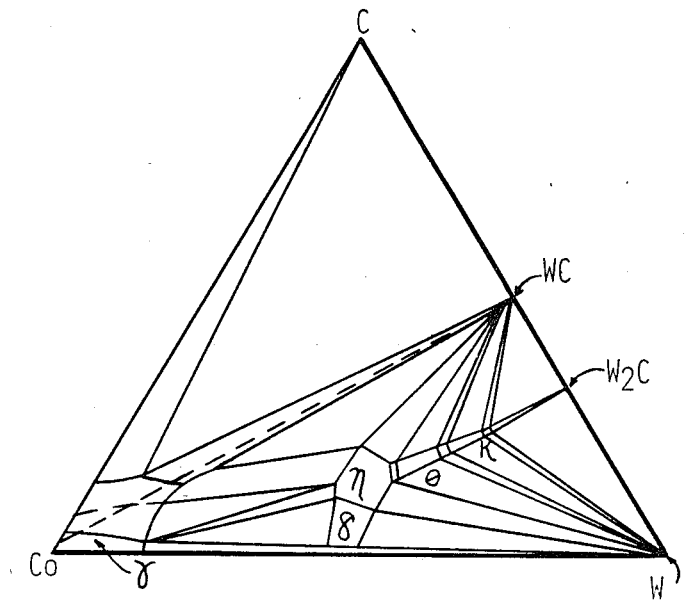
FIG. 1 is a isothermal section of the ternary W—C—Co phase diagram at 1400 degrees Centigrade.

All percentages set forth in this patent specification relate to percentage by weight of the various mixtures.

Virtually all current commercial carbide sintering furnaces contain graphite both in their construction and insulation package. If hydrogen was used in these furnaces as a sintering medium (without packing the parts in an $Al_2O_3$ sand-carbon mixture) the following reaction of hydrogen and solid carbon occurs:

$$2H_2 + C_{solid} \rightleftarrows CH_4$$

The kinetics of this reaction are such that it becomes meaningful, i.e. reaches equilibrium within a reasonable timeframe, between about 1000 to 1200 degrees C. Thus, an amount of $CH_4$ would be produced by this reaction above about 1000° C. such that at a sintering temperature (1400 degrees C.), carbide in the presence of $H_2$ and solid carbon would be driven to excess carbon in the structure. Therefore, the previously discussed Nissenhalts-Barts approach to carbon control would not be useful in current vacuum sintering furnaces.

The present invention overcomes the difficulties of obtaining proper carbon balance in WC—Co alloys shown in the prior art and does so in furnaces which may contain solid carbon at various temperatures and atmospheres. This invention allows the correction of carbon balance of WC—Co alloys both with an excess of carbon and a deficiency of carbon in the same furnace run at the same time. The correction procedure may be run during the normal dewax sinter cycle and requires only 30 minutes to two hours increase in the total cycle time. This invention easily accomplishes control of carbon to ±0.03% of the desired carbon content regardless of cobalt content or the WC grain size.

Consider the reactions:

$$C_{solid} + 2H_2 \rightleftarrows CH_4 \qquad \text{(Reaction 1)}$$

For a reaction $aA + bB \rightleftarrows cC + dD$ there exists an equilibrium constant $$K_p + \frac{(C)^c}{(A)^a} \frac{(D)^d}{(B)^b}$$

where (A) is the partial pressure of their constituent.

Thus for Reaction 1 above:

$$K_p = \frac{(CH_4)}{(H_2)^2}$$

Assume the total pressure is one atmosphere (For pressures other than one atmosphere the equations must be corrected due to pressure effects) Then:

$$-\Delta G^\circ_{298} = RT \ln k_p$$

where $\Delta G^\circ_{298}$ is the free energy of Reaction 1 at standard temperature and pressure R = gas constant T = temperature Then $$\ln k_p = (-\Delta H^\circ_o/RT) + \frac{A \ln T}{R} + \frac{BT}{R} + \frac{CT^2}{2R} \ldots + I$$

where:

$\Delta H_o^\circ$ is the enthalpy change for reaction 1 at 0°k,

I = an intergration constant $d(\Delta H^\circ) = \Delta C p dT$ $H_t^\circ = H_o^\circ + AT + \frac{1}{2}BT^2 + \frac{1}{3}CT^3$ where $\Delta C_p$ is the change in heat capacity at constant pressure for Reaction 1

$$\Delta C_p = C_p(CH_4) - 2C_p(H_2) = A + BT + CT^2 \ldots$$

$$C_p(CH_4) = 3{,}381 + 188.044T \times 10^{-3} - 43.00T^2 \times 10^{-7}$$

$$C_p(H_2) = \underline{-13.894 + .3998T \times 10^{-3} - 9.616T^2 \times 10^{-7}}$$

$$\Delta C_p = -10.513 + 18.444T \times 10^{-3} - 52.62T^2 \times 10^{-7}$$

$$H^\circ_{298} = -17865$$

$$\Delta H^\circ_T = \Delta H^\circ_o + AT + \tfrac{1}{2}BT^2 + \tfrac{1}{3}CT^3 + \ldots$$

$$\Delta H^\circ_{298} = -17865 =$$

$$\Delta H^\circ_o - 10.513T + 9.222T^2 \times 10^{-3} - 17.54T^3 \times 10^{-7}$$

$$\Delta H^\circ_o = -15507.66$$

$$\ln k_p = \frac{-\Delta H^\circ_o}{RT} + \frac{A \ln T}{R} + \frac{BT}{R} + \frac{CT^2}{2R} + \ldots + I$$

which yields:

$$\ln k_p = \frac{15507.66}{RT} - \frac{10.513 \ln T}{R} + \frac{9.222 \times 10^{-3} T}{R} - \frac{17.54T^2 \times 10^{-7}}{2R} + I$$

-continued $$-\Delta G^{\circ} = RT\ln k_p$$

$$\Delta G^{\circ}_{298} = -12140 \text{ cal/mole}$$

$$R = 1.987 \text{ cal/°c./mole}$$

thus $$\ln k_{p298} = \frac{12140}{RT} = 20.5$$

and $$I = 23.111$$

so that the equation reduces to:

$$\ln k_p = 23.111 + \frac{7804}{T} - 5.291\ln T + 4.641 \times 10^{-3}T - 4.415 \times 10^{-7}T^2$$

With this equation we can calculate the equilibrium mixture of $H_2$ and $CH_4$ at various temperatures in an environment where $H_2$ is in equilibrium with solid carbon. Consider the action of the equilibrium mixture of $H_2$ and $CH_4$ on carbide materials such as WC—Co.

A possible carbon transfer reaction with WC—Co is:

$$W + 2H_2 \rightleftarrows W + CH_4 \qquad \text{(Reaction 2)}$$

This equation (Reaction 2 ) would also have an equilibrium constant which would be dependent on temperature, or:

$$Kwc = \frac{(CH_4)}{(H_2)^2}$$

This indicates that the carbon balance in WC—Co alloys might be changed in a controllable manner by treating the parts in a $H_2$—$CH_4$ gas mixture at an appropriate temperature. If however the ratio of $CH_4$ to $H_2$ is in equilibrium with solid carbon then Reaction 2 should be forced to the left. In fact carbon would tend to be added to the WC until the surface of the parts were coated with carbon to satisfy the $C_{solid} + 2H_2 \rightleftarrows CH_4$ equilibrium. This would result in an excess carbon situation in the WC—Co alloy.

Thus in order to control the carbon level of WC—Co alloys in a hydrogen atmostphere in the presence of solid carbon (without packing the parts in $Al2O_3$ sand and carbon) it would be necessary to maintain a $H_2$—$CH_4$ ratio less than that dictated by the equilibrium in Reaction 1. Reaction 1 reaches equilibrium very quickly high temperatures (1000 to 1200 degrees Centigrade). Thus the carbon adjustment procedure should be carried out at less than about 1200 degrees Centigrade. It must also be carried out at a temperature high enough that the kinetics of the $W + CH_4 \rightleftarrows WC + 2H_2$ reaction are fast enough to effect the desired result in a reasonable time.

Figure 2:
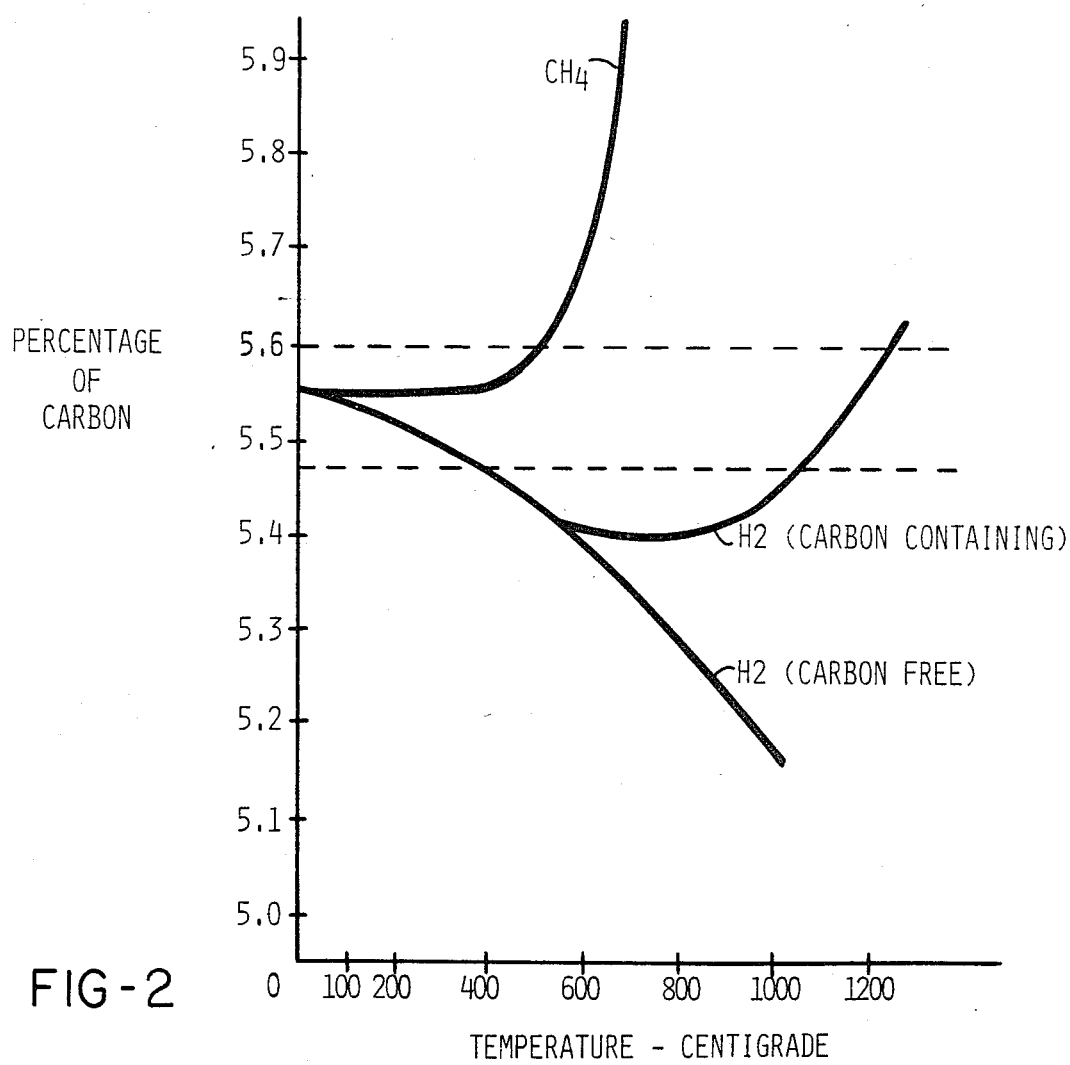
FIG. 2 is a diagram illustrating the effect on the carbon content of dewaxed preforms versus temperature when the preforms are subjected to a methane gas, hydrogen and hydrogen in a carbon containing and carbon free furnace.

Several experiments were run in order to determine the effect of temperature on the reaction of WC—Co alloys with $H_2$ only, $H_2$ in the presence of carbon, and $CH_4$ only. FIG. 2 details the results of these experiments.

The material used was a 10% cobalt 90% WC alloy of medium grain size. The powder was pressed into bars $1'' \times \frac{1}{4}'' \times \frac{1}{4}''$ and these bars placed in a carbon free furnace. They were than heated under flowing argon to the desired temperature. When the appropriate temperature was reached, the reactant gas was introduced and the argon turned off. The parts were then held for the desired period of time (ninety minutes). FIG. 2 shows that in a hydrogen atmosphere (carbon free) after a 90 minute hold the carbon level drops significantly at 400 degrees C. and continues to drop further as the temperature is raised through 1000 degrees C. (The dotted lines in FIG. 2 indicate the upper and lower bounds of carbon necessary for good quality parts for this material.) With a hydrogen atmosphere in the presence of solid carbon (parts inside of graphite box) the reaction is the same as hydrogen only, i.e. carbon free, up to about 600 degrees C. Beyond this the $C + 2H_2 \rightleftarrows CH_4$ reaction becomes effective and produces $CH_4$ which slows the carbon loss. At about 1200 degrees Centigrade this $CH_4$ producing reaction drives the material to excess carbon. In a pure $CH_4$ atmosphere there is little carbon picked up by the bars until about 400 degrees Centigrade after which carbon is picked up by the bars at a very high rate.

The effect of time may be seen in Table 1 below from 30 to 90 minutes hold time for parts having an initial carbon content of 5.56% Carbon. At 400 to 800 degrees C. there is a substantial difference in carbon loss for both $H_2$ only and $H_2$ plus solid carbon. AT 1000 degrees C. the kinetics are fast enough that there is little difference between 30 and 90 minutes in the carbon reaction. This indication that:

| | H2 | | | H2 CARBON CONTAINING | | | CH4 | |
|---|---|---|---|---|---|---|---|---|
| Temp °C. | T.C. | F.C. | ΔC | T.C. | F.C. | ΔC | T.C. | F.C.ΔC |
| 30 MIN. 250 cc/MIN START CARBON 5.56 | | | | | | | | |
| 400 | 5.53 | .06 | −.03 | 5.5 | .02 | −.06 | 5.54 | −.02 |
| 800 | 5.47 | .01 | −.16 | 5.46 | .01 | −.10 | 5.85 | +.29 |
| 1000 | 5.2 | .01 | −.36 | 5.45 | .01 | −.11 | 8.90 | +3.34 |
| 90 MIN. | | | | | | | | |
| 400 | 5.47 | .08 | −.09 | 5.46 | .2 | −.10 | 5.55 | −.01 |
| 800 | 5.20 | .06 | −.36 | 5.40 | .01 | −.15 | 7.04 | +1.48 |
| 1000 | 5.21 | .01 | −.35 | 5.45 | .01 | −.11 | 13.95 | +8.39 |

where
T.C. = Total Carbon
F.C. = Free Carbon
ΔC = Change in carbon

1. The $C_{solid} + 2H_2 \rightleftarrows CH_4$ reaction below that 1100 to 1200 degrees C. is slow enough to allow a non equilibrium mixture of $H_2$ and $CH_4$ in the presence of carbon to be maintained.

2. That an excess of $CH_4$ above the equilibrium for $W + CH_4 \rightleftarrows WC + 2H_2$ will add excess carbon to WC—Co alloys at temperatures at and greater than 400 degrees Centigrade.

3. The kinetics of the carbon transfer reaction WC—Co alloys is reasonably fast above about 800 degrees Centigrade.

These experiments establish that the temperature range for maintaining a non equilibrium mixture of $CH_4$, $H_2$ and solid carbon while still having reasonable carbon transfer reactions with WC—Co alloys is between 800 degrees C. to 1200 degrees C. They also indicate that carbon may be both added and subtracted from WC—Co alloys depending on the $CH_4$—$H_2$ ratio in this temperature region. Similar reactions will occur at lower temperatures but at slower rates.

To establish what ratio of $CH_4$ to $H_2$ is needed for equilibrium with WC—Co alloys, further experiments were run based on the following calculation:

For $C_{solid} + 2H_2 < \quad > CH_4$ $$kp = 23.111 + \frac{7804}{T} - 5.291 \ln T + 4.641 \times 10^{-3} T - 4.415T^2 \times 10^{-7}$$

| T | ln kp | kp | % ch4 | % H2 |
|---|---|---|---|---|
| 1000° C. | −3.527 | .029393 | 2.855 | 97.145 |
| 800° C. | −2.1454 | .117 | 10.47 | 89.53 |

Assume that in order to be in equilibrium with WC the percent of $CH_4$ needs to be ½ to 1/10 that necessary for equilibrium with solid carbon. Thus several experiments were run at 950 and 1000 degrees C. in a graphite containing production furnace with $CH_4$—$H_2$ ratios of approximately 1/10 to ½ that of the above calculations. A run was also made with a $CH_4$—$H_2$ ratio above that shown by the above calculations in order to establish the effect or high $CH_4$ ratios. A further run was made at 1000 degrees Centigrade with no $CH_4$ added to determine the effect of the $C_{solid}+2H_2 \rightleftarrows CH_4$ reactions on the alloys. The results were as follows:

The starting materials were 10% Co—90% WC alloys. Some of these materials were purposely made such that normal vacuum sintering would result in an excess carbon condition and some were made to result in a carbon deficient ondition under normal vacuum sintering.

Desired carbon content: 5.51%±0.04% C

Carbon content of Group 1 after normal vacuum sinter equals 5.56%. This resulted in an excess carbon condition.

Carbon content of Group 2 after normal vacuum sintering equals 5.24%. This resulted in a carbon deficient condition.

Carbon content of Group 3 after normal vacuum sintering equals 5.51%. This resulted in the proper carbon balance.

EXAMPLE #1

Parts from Groups 1 and 2 were placed in a production vacuum furnace which contained graphite. They were then vacuum dewaxed in the conventional manner. Subsequent to this they were heated under vacuum to 1000 degrees Centigrade and then subjected to an atmosphere initially containing 0.35% $CH_4$ (approximately 1/10 of $CH_4$ necessary to obtain an $H_2$, carbon and $CH_4$ equilibrium) and 99.65% $H_2$ for a period of 90 minutes. The furnace was then evacuated to approximately 100 u Hg and the temperature raised to 1400 degrees C. and held for 30 minutes. The resulting carbon contents are listed below:

Group 1—5.50% carbon
Group 2—5.49% carbon

This treatment resulted in removing carbon from Group 1 and adding carbon to Group 2 such that both groups were brought into the desired carbon balance.

EXAMPLE #2

Samples were prepared and treated in the same manner under the same conditions as Example 1 except that the carbon correction temperature was lowered to 950 degrees C. The resulting carbon contents are listed below:

Group 1—5.51% carbon
Group 2—5.45% carbon

This shows that although Group 1 lost carbon, it lost less carbon than at 1000 degrees Centigrade and the Group 2 samples gained carbon but not enough to fall into the desired range of 5.51%±0.04% carbon. Thus the kinetics of the reaction was slowed enough that more time would be needed to bring both groups into the desired range.

EXAMPLE #3

The samples were prepared and treated in the same manner under the same conditions as Example 1 except the time was shortened to 60 minutes. The resulting carbon contents for both Group 1 and Group 2 following the process are listed below:

Group 1—5.51% Carbon
Group 2—5.47% carbon

This indicates that, when compared to example 1 sixty minutes was not enough time for full equilibrium of the $WC+2H_2 \rightleftarrows W+CH_4$ reaction even though Group 1 samples still lost carbon and Group 2 samples gained carbon but less than in Example 1.

EXAMPLE #4

The samples were prepared and treated in the same manner under the same conditions as Example 1 except that the percentage of $CH_4$ was increased to 1.4% of the $H_2$—$CH_4$ mixture which is approximately one half that of the equilibrium value for the $C_{solid}+2H_2 \rightleftarrows CH_4$ reaction. Also Group 3 samples (proper carbon content) were added to the run. The resulting carbon contents are listed below:

Group 1—5.53% carbon
Group 2—5.51% carbon
Group 3—5.51% carbon

This shows similar results to Example 1 except that the carbon contents of both groups are slightly higher. In addition, the carbon levels are in the middle of the desired range and are held to 5.52%±0.01% which shows carbon control far better than can be achieved by conventional processing. This example also illustrates that properly carbon balanced materials would not be affected by this treatment.

EXAMPLE #5

The samples were prepared and treated in the same manner under the same conditions as Example 1 except that the percentage of $CH_4$ in the $H_2$ and $CH_4$ mixture was increased to 8% which is approximately 2½ times that of the equilibrium value for the $C_{solid}+2H_2 \rightleftarrows CH_4$ reaction and samples for Group 3 were added. The resulting carbon contents are listed below:

Group 1—6.98% carbon
Group 2—6.94 carbon
Group 3—6.46% carbon

This indicates that excess $CH_4$ causes all groups to pick up a great deal of carbon and drives them to extreme excess carbon conditions

EXAMPLE #6

The samples were prepared and treated in the same manner and under the same conditions as Example 1 except that no $CH_4$ was added to the hydrogen. Samples for Group 3 were added. The resulting carbon contents are listed below:

Group 1—5.50% carbon
Group 2—5.49% carbon
Group 3—5.51% carbon

This shows that at 1000 degrees Centigrade the $C_{solid}+2H_2 \rightleftarrows CH_4$ reaction is partially complete and produced at least 0.35% Ch4 in the atmosphere (Compare to Example 1) and less than 1.4% $CH_4$ (compare to Example 4). In this example, the hydrogen gas reacts with the carbon components and insulation package in the furnace to generate the $CH_4$.

Therefore, approximately 1% $CH_4$ should be added to the $H_2$ at the temperature to minimize the attack of the $H_2$ on the solid carbon components and insulation of the furnace.

Similar results may be obtained at temperatures below 950 degrees Centigrade but would require longer times for substantial carbon changes to be effected.

The method in brief then comprises the steps of heating WC—Co preforms in a carbon containing furnace to an appropriate temperature, preferable 800°-1200° Centigrade, under vacuum. Holding at this temperature for a period of time, preferably 15 minutes to 5 hours while subjecting them to a mixture of $CH_4$ and $H_2$ and in which the percent of $CH_4$ is 10% to 90% of that required for the equilibrium of the reaction $C_{solid}+H_2 \rightleftarrows CH_4$ at that temperature and at a selected pressure. This procedure has been shown to be capable of producing WC—Co alloy of correct carbon balance even when alloys both high in carbon and low in carbon as well as those deficient in carbon are treated in the same run.

Further, it is preferable to treat the WC—Co parts at a temperature high enough such that the kinetics are fast enough to allow proper carbon equilibrium if the reaction, $WC+2H_2 \rightleftarrows W+CH_4$ in a reasonable time. Also, the temperature should be low enough such that the reaction $C_{solid}+2H_2 \rightleftarrows CH_4$ is slow enough not to reach equilibriim during the same time period or with high enough gas flows that the reaction does not reach equilibrium during the gas resident time. In this regard, it is important to remember that, at a selected pressure, e.g. one atmosphere, within the temperature range, the reaction $WC+2H_2 \rightleftarrows W+CH_4$ substantially reaches equilibrium much more rapidly than the reaction $C_{solid}+2H_2 \rightleftarrows CH_4$. Thus the temperature range is preferably 800 to 1100 degrees Centigrade and move preferably 900 to 1000 degrees Centrigrade.

The actual percentage of $CH_4$ in the $H_2$—$CH_4$ mixture for proper treatment will vary a great deal with temperature but should be in the range of from 10% to 90% of the equilibrium value produced by the reaction C solid$+2H_2 \rightleftarrows CH_4$ at the selected temperature and pressure, preferably in the range of 20 to 80% and more preferably in the range of 20 to 50%.

Other methods of accomplishing the carbon correction would be to heat the parts in a $H_2$—$CH_4$ gaseous mixture up to a maximum of approximately 1200 degrees Centigrade and vary the percentage of $CH_4$ in the mixture appropriately as the temperature is raised. Alternatively the parts might be heated in a mixture of $CH_4$ and $H_2$ appropriate for the maximum temperature to be used for treatment prior to vacuum sintering and depending on the hold at the final treatment temperature to correct the carbon balance.

The preferred embodiment of this invention would involve the following steps:

1. Place WC—Co preforms into a carbon containing sintering furnace.

2. Dewax the preforms in the conventional manner in vacuum, hydrogen, or flowing wash gas such as nitrogen of argon.

3. Heat the preforms in vacuum to the desired treatment temperature 400-1200 degrees Centigrade preferably 800-1100 degrees Centigrade and move preferably 900 to 1000 degrees Centigrade.

4. While holding at the desired temperature, introduce a mixture of $H_2$ and $CH_4$ of the appropriate percentage of $CH_4$. The hold time is preferably 15 minutes to 5 hours. The percentage of $CH_4$ in the mixture will be between 10 and 90% of the equilibrium value produced by the reaction $C_{solid}+2H_2 \rightleftarrows CH_4$ at the selected temperature, preferably 20 to 80% and more preferably 20 to 50%. The final treatment pressure is most conveniently approximately 1 atm. The process may be done at pressure above or below 1 atmosphere but, since the equilibrium value of $CH_4$ for both Reaction 1 and 2 are pressure dependent (non ideal gases), the calculations for the percentage of $CH_4$ will need to be corrected for pressure. The desired ranges for the percentage of $CH_4$ will still, however, be 10 to 90% of the equilibrium value produced by the reaction $C_{solid}+2H_2 \rightleftarrows CH_4$ at whatever pressure is selected. Furthermore, the most desireable temperature for the process may change somewhat at higher or lower pressures since the kinetics of the reactions will change. For example, the use of low pressures may allow the process to be accomplished above 1200 degrees Centigrade due to slower kinetics of the $C_{solid}+2H_2 \rightleftarrows C_4$ reaction.

5. When the carbon correction process is complete, evacuate the furnace down to 1 to 0.01 torr and increase the temperature to the sinter temprature of the alloy.

6. Hold the sintering temperature for the desired period of time and cool the parts and remove from the furnace.

The advantage of this process over conventional processing is that very tight finished carbon control may be accomplished even though the initial carbon balance is not totally correct. In this process material with low carbon and high carbon may be corrected in the same run without affecting the carbon balance of correctly balanced materials. Also since the carbon level will come to equilibrium, time is not of the essence in the sense that holds longer than that necessary for the carbon correction to be accomplished will not be harmful.

Although the examples all were conducted using WC—Co dewaxed preforms, it would be obvious to one having ordinary skill in the art that the same results would be obtained with TiC, TaC, NfC, MoC and mixtures thereof as well as with other binders than Co, such as Fe, Ni and mixtures thereof.

Having described my invention, many modifications thereto will become apparent to those skilled in the art without deviation from the spirit of the invention as defined by the scope of the appended claims.

I claim:

1. A method for controlling the carbon content of dewaxed carbide preforms in a carbon containing furnace comprising the steps of:

placing the preforms in the carbon containing furnace, heating the furnace to a predetermined temperature range in which the chemical reaction, $C_{solid}+2H_2 \rightleftarrows CH_4$ reaches equilibrium in a first time period at a selected pressure and in which the chemical reaction $$XC+2H_2 \rightleftharpoons X+CH_4$$

where X is selected from the group of W, Ti, Ta, Hf and Mo, reaches equilibrium in a second time period at said selected pressure, said second time period being shorter in duration than said first time period or the resident time of the gaseous mixture is less than the second time period, introducing a mixture of $H_2$ and $CH_4$ into said furnace wherein the percentage of $CH_4$ is between 10% and 90% necessary to for equilibrium of the reaction $$C_{solid}+2H_2 \rightleftharpoons CH_4$$

at said selected pressure and said temperature range, and maintaining said furnace at said temperature range for a duration between said first and second time periods.

2. The method as defined in claim 1 wherein said introducing step comprises introducing a mixture of $CH_4$ and $H_2$ wherein the percentage of $CH_4$ is between 20% and 80% necessary for equilibrium of the reaction $$C_{solid}+2H_2 \rightleftharpoons CH_4.$$

3. The method as defined in claim 1 wherein said introducing step comprises introducing a mixture of $CH_4$ and $H_2$ wherein the percentage of $CH_4$ is between 20% and 50% necessary for equilibrium of the reaction $$C_{solid}+2H_2 \rightleftharpoons CH_4.$$

4. The invention as defined in claim 1 wherein said temperature range is between 800° C. and 1100° C.

5. The invention as defined in claim 1 wherein said temperature range is between 900° C. and 1000°.

6. The invention as defined in claim 1 wherein said second time period is between fifteen minutes and five hours.

7. The invention as defined in claim 1 and further comprising the steps of:

evacuating said furnace following said time duration, and sintering said preforms.

8. A method for controlling the carbon content of dewaxed carbide preforms in a carbon containing furnace comprising the steps of:

placing the preforms in the carbon containing furnace, heating the furnace to a predetermined temperature range in which the chemical reaction, $C_{solid}+SH_2 \rightleftharpoons CH_4$ reaches equilibrium in a first time period at a selected pressure and in which the chemical reaction $$XC+2H_2 \rightleftharpoons X+CH_4$$

where X is selected from the group of W, Ti, Ta, Hf and Mo, reaches equilibrium in a second time period at said selected pressure, said second time period being shorter in duration than said first time period or the resident time of the gaseous mixture is less than the second time period, introducing $H_2$ into said furnace so that said $H_2$ reacts with carbon in the furnace to form $CH_4$ wherein the percentage of $CH_4$ is between 10% and 90% necessary to form equilibrium of the reaction $$C_{solid}+2H_2 \rightleftharpoons CH_4$$

at said selected pressue and said temperature range, and maintaining said furnace at said temperature range for a duration between said first and second time periods.

9. The method as defined in claim 8 wherein the percentage of $CH_4$ is between 20% and 80% necessary for equilibrium of the reaction $$C_{solid}+2H_2 \rightleftharpoons CH_4.$$

10. The method as defined in claim 8 wherein the percentage of $CH_4$ is between 20% and 50% necessary for equilibrium of the reaction $$C_{solid}+2H_2 \rightleftharpoons CH_4.$$

11. The invention as defined in claim 8 wherein said temperature range is between 800° C. and 1100° C.

12. The invention as defined in claim 8 wherein said temperature range is between 900° and 1000°.

13. The invention as defined in claim 8 wherein said second time period is between fifteen minutes and five hours.

14. The invention as defined in claim 8 and further comprising the steps of:

evacuating said furnace following said time duration, and sintering said preforms.

* * * * *

UNITED STATES PATENT AND TRADEMARK OFFICE

CERTIFICATE OF CORRECTION

PATENT NO. : 4,579,713

DATED : April 1, 1986

INVENTOR(S) : Roy C. Lueth

It is certified that error appears in the above-identified patent and that said Letters Patent are hereby corrected as shown below:

Column 1, line 9, delete "HfC" and insert --NfC--.

Column 5, line 28, delete "W" first occurrence, and insert --WC--.

Signed and Sealed this

Eleventh Day of November, 1986

*Attest:*

DONALD J. QUIGG

*Attesting Officer*

*Commissioner of Patents and Trademarks*